US008356971B2

(12) United States Patent
Detch

(10) Patent No.: US 8,356,971 B2
(45) Date of Patent: Jan. 22, 2013

(54) DISC TURBINE WITH STREAMLINED HUB VANES AND CO-AXIAL EXHAUST TUBE

(76) Inventor: John W. Detch, Ventura, CA (US)

( * ) Notice: Subject to any disclaimer, the term of this patent is extended or adjusted under 35 U.S.C. 154(b) by 673 days.

(21) Appl. No.: 12/653,648

(22) Filed: Dec. 17, 2009

(65) Prior Publication Data

US 2011/0150642 A1 Jun. 23, 2011

(51) Int. Cl.
*F03B 5/00* (2006.01)

(52) U.S. Cl. ..... 415/90; 415/202; 415/229; 416/174; 416/175

(58) Field of Classification Search ..... 415/90, 415/202, 229; 416/174, 175
See application file for complete search history.

(56) References Cited

U.S. PATENT DOCUMENTS

| | | | |
|---|---|---|---|
| 1,061,206 | A | 5/1913 | Tesla |
| 6,682,077 | B1 | 1/2004 | Letourneau |
| 6,692,232 | B1 | 2/2004 | Letourneau |
| 6,973,792 | B2 | 12/2005 | Hicks |

*Primary Examiner* — Ninh H Nguyen

(74) *Attorney, Agent, or Firm* — J. E. McTaggart

(57) ABSTRACT

In a disc turbine for operation from steam, including superheated steam, a stack of horizontally oriented discs is fitted centrally with a hub having a closed upper end from which a driveshaft extends upwardly, supported by a bearing system. The hub is configured with identical vanes arrayed uniformly about the central axis and specially shaped to accomplish a set of desired flow path objectives. The vanes are generally tapered such that their cross-sectional shape evolves from predominantly solid material in area at the top of the hub to predominantly open area at the bottom of the hub, where the flow paths proceed downwardly into a tubular exhaust passageway. The entry to the exhaust passageway may take the form of effectively a hollow portion of the shaft in the exhaust region, which may be supported from the enclosure by a bearing set. The central opening in each disk, and thus in the stack, and in the periphery of the hub are both configured with a complementary mating interface pattern: e.g. three ⅓ revolution spiral paths in a radial array with a semicircular-shaped key step extending radially across each the spiral end offset, the set of key steps serving to transmit drive torque from the discs to the hub while avoiding direct solid connection therebetween, for purposes of accommodating operational thermal expansion. A downward-facing tubular exhaust passageway allows an unimpeded vortex exhaust gas flow path that evolves smoothly from the spiral flow path of gas from disc stack, as guided by the specially-shaped vanes in the hub.

9 Claims, 6 Drawing Sheets

DISC TURBINE WITH STREAMLINED HUB VANES AND CO-AXIAL EXHAUST TUBE

FIELD OF THE INVENTION

The present invention relates to the field of disc turbines and more particularly to an exhaust portion of a steam-powered disc type turbine engine with a fluid exiting from the rotor discs in a spiral path that is converted in streamlined flow paths directed by specially-shaped vanes in the hub region, with the exhaust gas exiting in a vortex flow path through a coaxial exhaust tube perpendicular to the central shaft axis.

BACKGROUND OF THE INVENTION

The disc type turbine is a bladeless turbine machine that operates from a pressurized fluid, e.g. liquid, gas or steam, directed by one or more nozzles in a generally tangential direction into the perimeter region of a rotor assembly of multiple closely-spaced discs, which become driven to rotate by the principle of boundary layer drag on the surfaces of the closely-spaced discs.

Initial development and usage of disc type turbines has been historically limited by relatively low efficiency, along with unavailability of disc material capable of reliably withstanding high temperatures, stresses and harsh environmental factors, e.g. when driven by super-heated steam.

Subsequent developments have resulted in the realization of somewhat higher efficiency and analysis has indicated that, in theory, disc type turbines have potential for very high operating efficiency beyond what has been realized in practice to date. Along with the development of more satisfactory disc materials, there has been a resurgence of interest in disc type turbines as candidates for present day steam-driven applications.

DISCUSSION OF KNOWN ART

The invention of the disc type turbine is credited to Nikola Tesla, whose 1913 U.S. Pat. No. 1,061,206 for a TURBINE discloses an early example of the disc type turbine and provides a discussion of its basic principles.

In the Tesla patent, FIG. 1 shows a partial end view, with casing removed, including a pair of oppositely-directed jets 24 each with a corresponding control valve 29 by which the direction of rotation, indicated by arrows, can be selected by opening one of the valves 29 to activate the corresponding jets 24. The rotor (termed "runner" by Tesla) is a stack of identical discs 13 configured with an open central hub region where the discs are attached to the shaft 16 via spokes 15 with orifices 14 between spokes 15, occupied by fluid flow.

FIG. 1 of the present disclosure shows a simplified representation of Tesla's FIG. 2, both showing a vertical cross-section of a Tesla rotary engine or turbine with enclosure casing 19 in place. The central hub region of the rotor is seen to extend outwardly to form and communicate with two flanking exhaust regions, together forming a transition zone 30 enclosed on each side by casings 19, each of which is shaped as an inverted U (see outline shown in Tesla's FIG. 1) and extend downwardly to form a pair of bottom exhaust openings: orifices 20 (Tesla FIG. 1)

In the transition region 30, the fluid flow stream from between discs 13 divides symmetrically into two main half streams indicated as 34', 36', and 38' at left and 34", 36" and 38" at right. Flowing into and through the relatively open transition region 30 the two half-streams continue downwardly through exhaust zone 32, to exit at orfices 20 at the bottom.

The Tesla machine could be designed to operate from fluids that range from liquids such as water or oil at atmospheric temperatures to gasses such as hot air or steam up to about 1000 degrees F. Since the present invention addresses particularly the challenges in disc turbine operation from steam, which may be dried and/or superheated to about 1500 degrees F., further discussion of fluid flow herein will refer to flow of gas in the form of steam injected into the rotor disc stack, remaining as a gas through the hub region and the exhaust passageway where it exits as a gas at some temperature above the boiling point.

The disc turbine can be designed for the exhaust gas to be released to the environment, to be directed to a further destination via an exhaust pipeline extension, or to be provided as input to an auxiliary energy recovery system. In any case, the exhaust gas should be allowed to escape as freely as possible: it is important to avoid a build-up of excessive back pressure in the hub region to an extent that could impact the performance and efficiency of the main energy conversion that takes place in the stack of discs 13, which involves a substantial drop in gas pressure.

When the gas flow reaches the hub and escapes from the spaces between discs 13, the transfer of energy to the rotor and to any payload attached to shaft 16 is essentially fulfilled.

In the present example of the Tesla machine, the spiral planar laminar gas flow pattern through the disc stack is not allowed to continue smoothly into the hub region. Instead the gas flow path becomes abruptly disturbed as it transitions into the hub and through the hub/transition zone 30, where the momentum of the spinning spiral velocity component, which would otherwise tend to evolve into a vortex, i.e. corkscrew-shaped, exhaust flow pattern, instead becomes abruptly arrested by the forced flow diverted into the two fixed passageways in the exhaust zone 30, whose rectangular cross-sectional shape would act to prevent any tendency for the original spiral flow pattern to evolve into a residual vortex pattern in the exhaust region.

Flow paths 34' and 34" in FIG. 1 represent the gas flow in this XY plane from the portion of the rotating discs 13 directly above the hub region at an instant in time, the two paths being forced to divert outwardly in the hub/transition zone 30 to enter the offset locations of the two flanking passageways in the exhaust zone 32.

Flow paths 36' and 36" represent the gas flow from the midway portions of discs 13 entering from the sides of the hub at the level of shaft 16, similarly having to divert to the offset fixed exhaust passageways, again forcing the spiral flow pattern to an abrupt halt.

Flow paths 38' and 38" represent the gas flow from the portion of the discs 13 that are directly beneath the hub region at that point in time; in this case the two paths are forced not only to divert, but furthermore the flow path is forced to actually reverse general direction by 180 degrees in the hub/transition zone 30 in order to enter the offset fixed exhaust passageways in the exhaust zone 32, where. as with the other gas flow paths shown in FIG. 1, any residual vortex flow pattern, carried over from the initial spiral flow pattern in plates 13, is brought to a rather abrupt halt.

The circular arrows 40 indicate general "back-flow" regions within the hub/transition zone 30 that are likely to become prone to turbulence, i.e. eddy currents, depending on various factors such as temperature, pressure, velocity and gas viscosity, and gradients thereof, introducing losses that, along with the break-up of spiral-to-vortex flow patterns, and build-up of back pressure, impose substantial limitations on available performance and efficiency.

U.S. Pat. No. 6,973,792 B2 to Hicks for a METHOD OF AND APPARATUS FOR A MULTI-STAGE BOUNDARY LAYER ENGINE AND PROCESS CELL discloses such which achieves high thermal efficiencies and high mechanical power output for use in power generation and other fields, utilizing a "novel dovetail attachment of the disc packs".

U.S. Pat. Nos. 6,682,077 B1 and 6,692,232 B1 to Letourneau are directed to seals and disc spacers respectively in disc turbines In view of the known art, the present inventor, seeking high efficiency in superheated steam-driven turbines, has concluded that in addition to disc optimization with modern materials, the challenge of more closely approaching the theoretical potential high efficiency in disc type turbines now requires a novel change in the structure of the hub portion to accomplish flow patterns that are more streamlined and free of turbulence, whether designed for the exhaust gas to be simply expelled, redirected or further processed for energy recovery.

Objects of the Invention

It is an object of the invention to configure a hub and an exhaust passageway of a disc turbine in a manner to accomplish a streamlined and efficient pattern of high temperature gas flow exiting from a central opening in a stack of closely-spaced discs, transitioning through the hub and out the exhaust passageway.

It is a further object to configure the hub in a manner to provide guidance flow paths that will minimize disturbances to gradients of gas temperature, velocity, pressure and volume in transitioning from the disc stack to the exhaust passageway.

It is a further object to configure the hub in a manner to provide smooth guidance in the flow path evolution from the spiral flow path in the disc stack to a vortex flow in the exhaust passageway, with minimal flow disturbance and loss if energy due to the evolution.

It is a further object to optimize the turbine including the disc stack, hub and exhaust passageway for operation from superheated steam up to 1500 degrees F.

It is a further object to configure and orient the turbine in a manner to provide automatic expulsion of any unwanted accumulation of water condensed from the steam.

It is a still further object to couple the disc stack to the hub in an indirect keyed manner that will always apply required drive torque from the disc stack to the hub, and yet avoid direct fastening there between to allow an anticipated degree of thermal expansion and contraction of the discs without adverse effects.

SUMMARY OF THE INVENTION

The above objects have been met in the present invention of improvements in a disc turbine including novel structure wherein the disc stack is oriented horizontally and the hub is closed at its upper end from which a driveshaft extends upwardly, supported by a bearing system. The hub is configured with a plurality of like vanes arrayed uniformly about the central axis and specially shaped to accomplish the desired flow path objectives. The vanes are generally tapered such that their cross-sectional shape evolves from predominantly solid area at the top of the hub to predominantly open area at the bottom of the hub, where the flow paths proceed downwardly into a tubular exhaust passageway. The entry to the exhaust passageway may take the form of effectively a hollow shaft which may be supported from the enclosure by a bearing set. The central opening in the disc stack and the periphery of the hub are both configured with a complementary interface pattern that provides an offset drive step formed across the two ends of a one revolution spiral shape around the hub. The downward-facing tubular exhaust passageway allows an unimpeded vortex exhaust gas flow path that is smoothly evolved from the spiral flow path of gas from disc stack by guidance of the specially shaped vanes in the hub.

DETAILED DESCRIPTION

Figure 1:
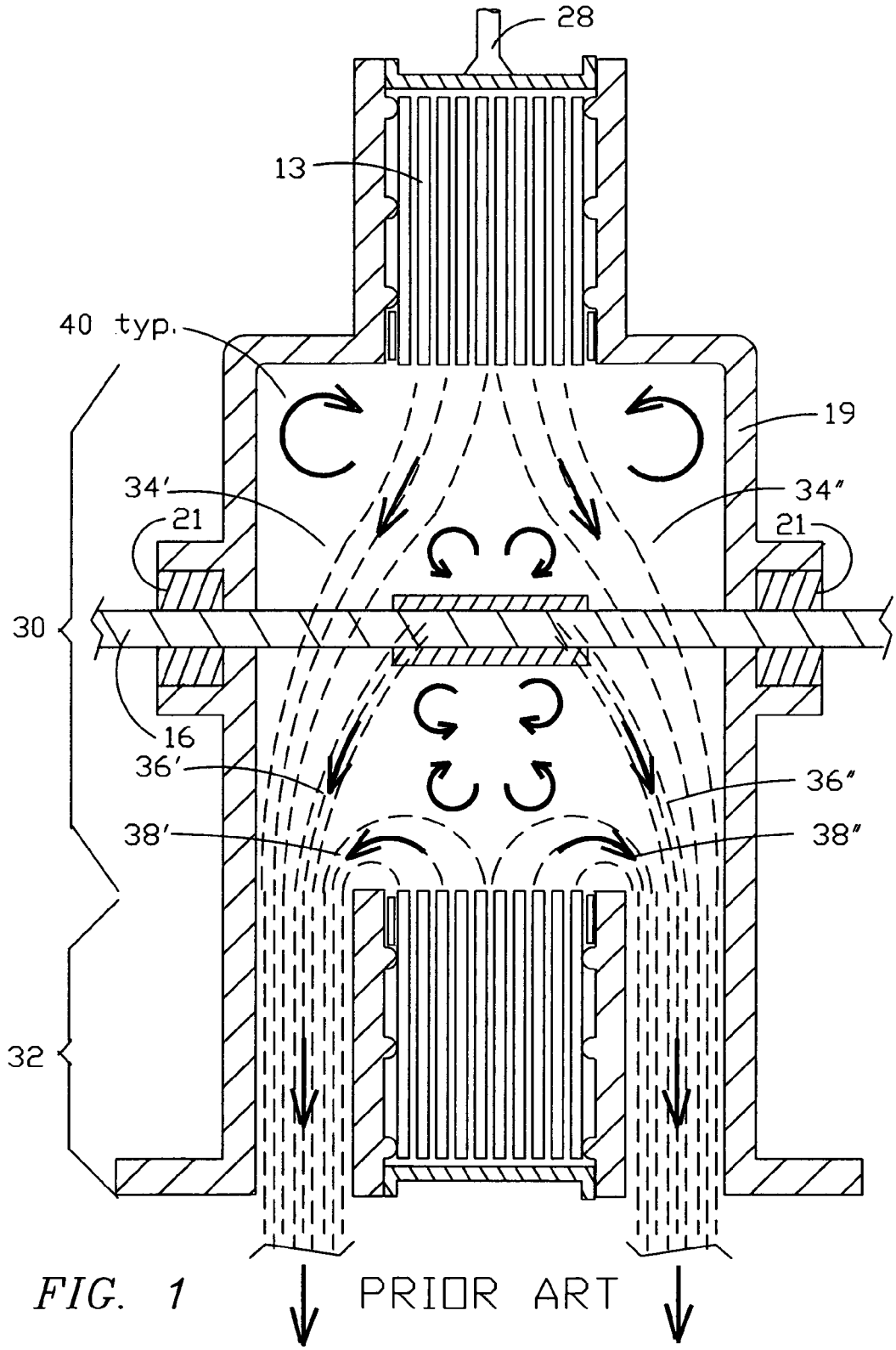
FIG. 1 PRIOR ART
FIG. 1 is a cross-sectional representation of a Tesla type disc turbine of known art, showing generalized fluid flow paths from the disc stack to the exhaust passageways, as discussed above.

FIG. 1 is a cross-sectional representation of an early Tesla disc type turbine as discussed above under DISCUSSION OF KNOWN ART showing generalized fluid flow paths from the disc stack to the exhaust passageways.

Figure 2:
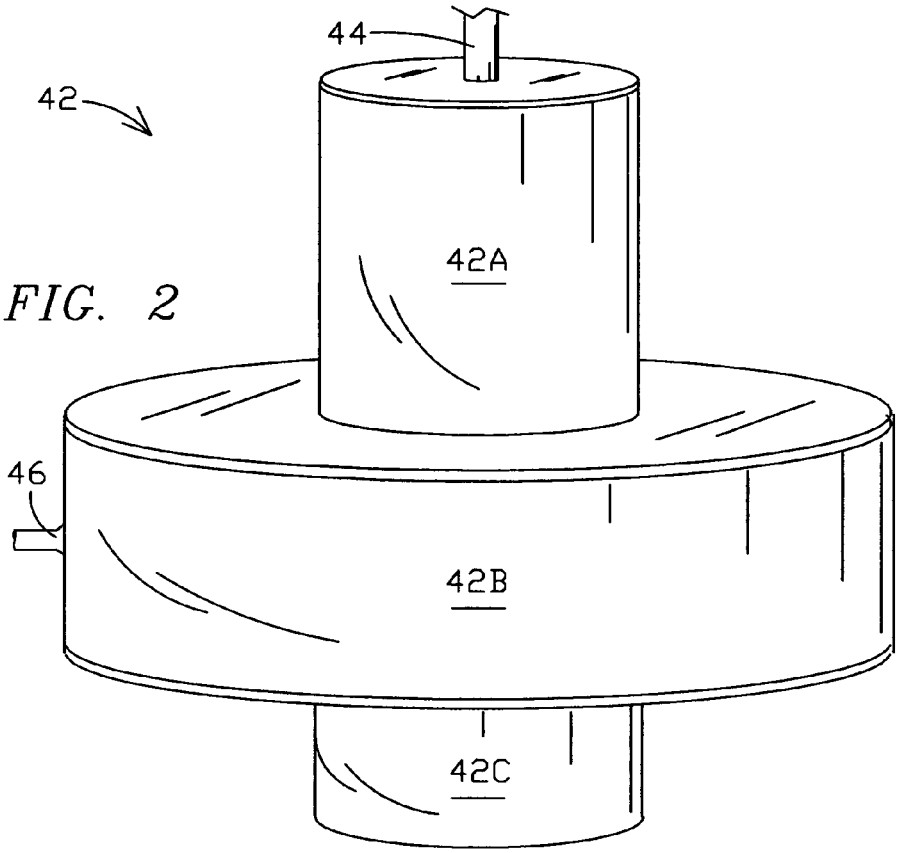
FIG. 2 is a perspective elevational exterior view of a disc turbine in accordance with the present invention.

FIG. 2 is a three-dimensional elevation view depicting a simplified representation of a disc type turbine 42 in accordance with the present invention, with three cylindrical enclosure portions. A driveshaft 44 extends upwardly from a shaft-bearing upper end enclosure portion 42A, which is attached to an enlarged disc enclosure portion 42B, which is fitted with at least one nozzle 46, oriented to direct the driving flow tangentially to the disc stack. Enclosure portion 42B is enclosed on the lower opposite side by end enclosure 42C configured with an exhaust tube portion extending downwardly as shown.

Figure 3:
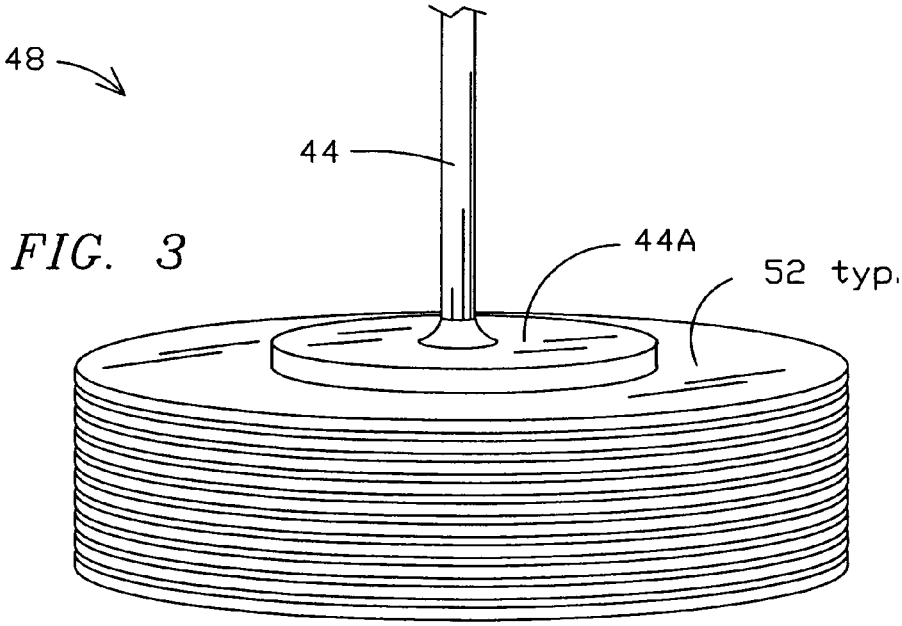
FIG. 3 is a perspective elevational view of the rotor assembly of the disc turbine of FIG. 2.

FIG. 3 is a three-dimensional elevation view of a disc rotor assembly 48 shown removed from a disc type turbine as in FIG. 2. Shaft 44 has a circular end plate 44A attached to a stack of circular discs 52, which are held separated from each other by a designated disc-spacing dimension that is a key operating parameter that is selected for the particular operating fluid, speed (rpm) and other conditions.

Figure 4:
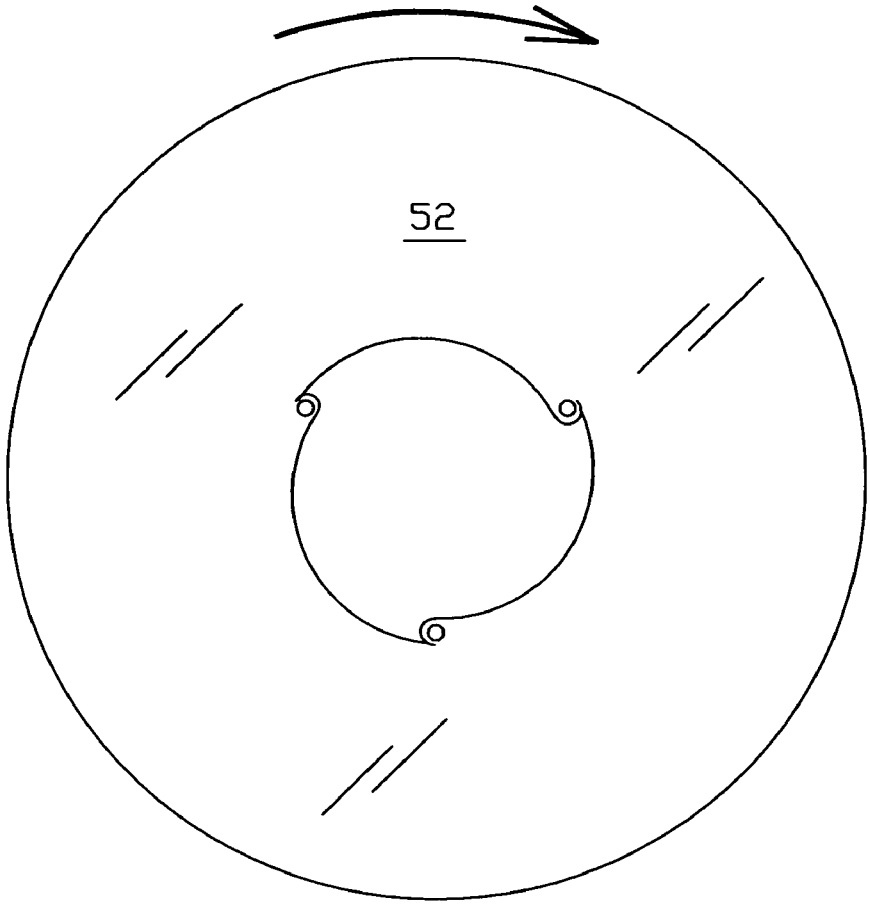
FIG. 4 is a top view showing the outline shape of the discs in the rotor assembly of FIG. 3.

FIG. 4 is a top view of a disc 52 as in FIG. 3. Each disc 52 is made from designated durable sheet material with a surface of designated texture (typically smooth) on each side, and configured with a central hub opening shaped as shown, intended for rotation in the clockwise direction indicated by the curved arrow above disc 52. The disks stacked in the rotor may be held in alignment by bolts inserted through the three holes in each disc, shown in the triad array around the central hub opening.

Figure 5:
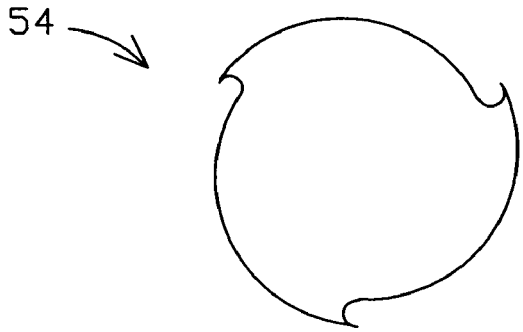
FIG. 5 is a top view showing the outline of a hub which is shaped to fit into the central opening shown configured in the disc of FIG. 4.

FIG. 5 is a top view outline of a hub 54 showing the triple-spiral shape with semicircular key steps at the offset ends, made to fit into the central opening of disc 52 of FIG. 4 such that the two items become keyed together in a manner to ensure positive drive to the hub 54 in the designated clockwise direction, while allowing for operational variations in thermal expansion of the discs 52.

Figure 6:
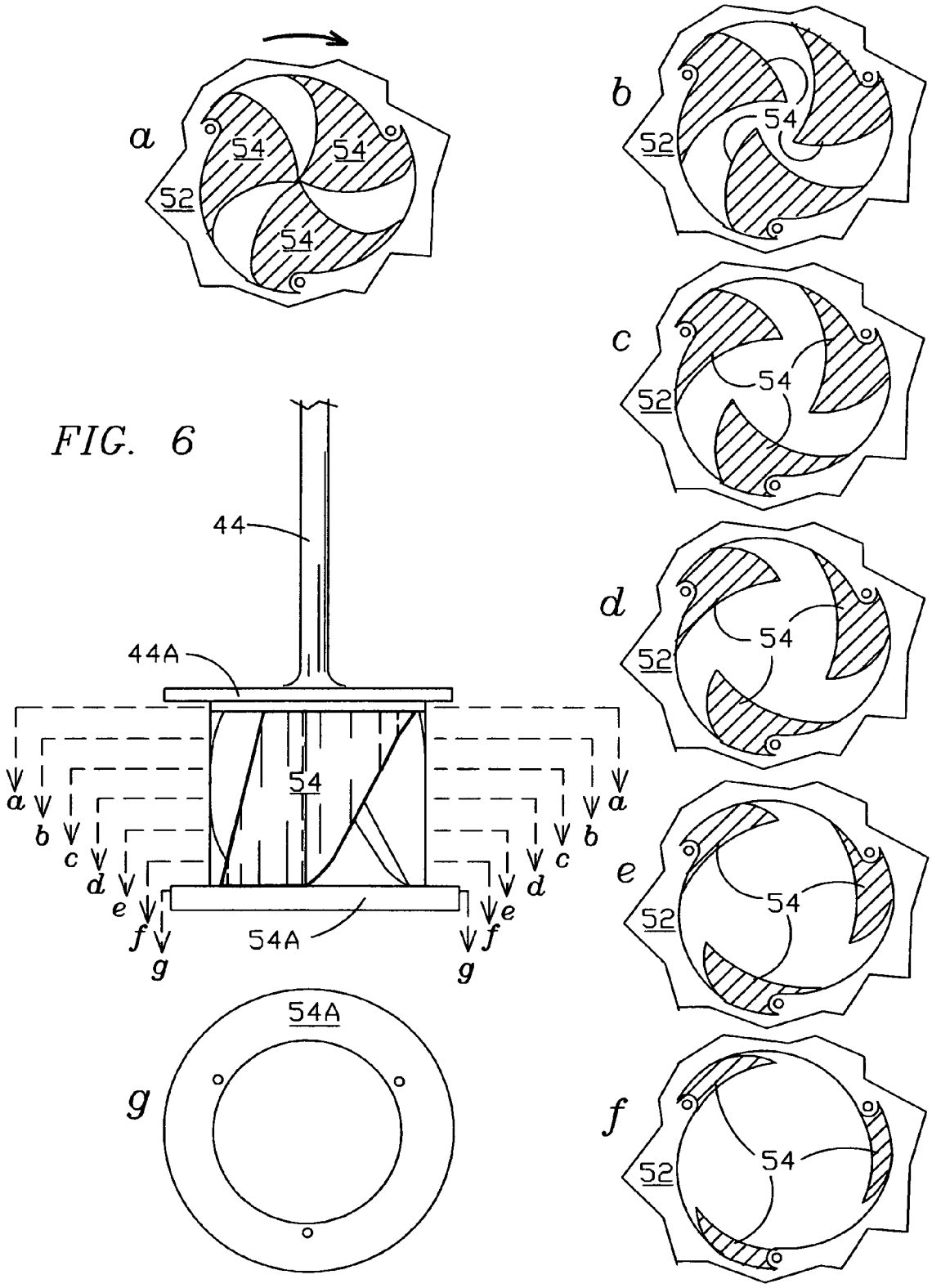
FIG. 6 is an elevational view of the hub of FIG. 5, indicating seven levels at which cross sections are taken and shown as a-g, showing the special tapered and contoured shape of three identical support vanes configured within the hub.

FIG. 6 is an elevational view of a rotor assembly including driveshaft 44 and drive rotor 44A attached to hub 54, as it would appear before assembly with the disc stack. Shown are seven cross-sections taken at levels a-g indicated, ranging from top at drive rotor 44A to end ring 54A at the bottom of hub 54. The corresponding cross-sections a-g of the three tapered and contoured support vanes of hub 54 are shown as viewed from above FIG. 6, each in a triad polar array 120 degrees apart, and each surrounded by a cutaway portion of a corresponding disc 52. The complex tapered shape of the vanes is evident in the progression from the predominantly solid pattern at axis a at rotor disc 44A at the upper end of hub 54 to the predominantly open pattern at axis f, near the lower end of hub 54, and finally, fully open as shown at axis g in end cap 54A at the extreme lower end, where the fully open triple-spiral pattern will be closely approximated by the lowermost disc 52. To optimize the flow path in this transitional region, the tubular exhaust passageway beneath is made to have approximately the same cross-sectional area as at axis g of end ring 54A at the lower end of hub 54.

The evolving shape of the vanes in hub 54 as shown in the progression of cross-sections a-g has been specially configured to create optimal flow paths to guide gas leaving the spaces between discs 52, entering all sides of hub 54, transitioning through hub 54 and then exiting from the bottom of hub 54 to enter the exhaust passageway. It is also part of the design objective to shape the three vanes in hub 54 in a manner to keep the cross-sectional area and thus the flow velocity as uniform as possible throughout this total flow path.

The vanes in hub 54 are shaped to create an optimally smooth transition from the horizontal spiral flow pattern of gas in the stack of discs 52 to the vertical vortex flow of the gas in the exhaust passageway, in effect a generally perpendicular rerouting, with minimal disturbance to gradients of temperature, volume, pressure and velocity of the gas throughout the passage of the gas through hub 54.

Figure 7:
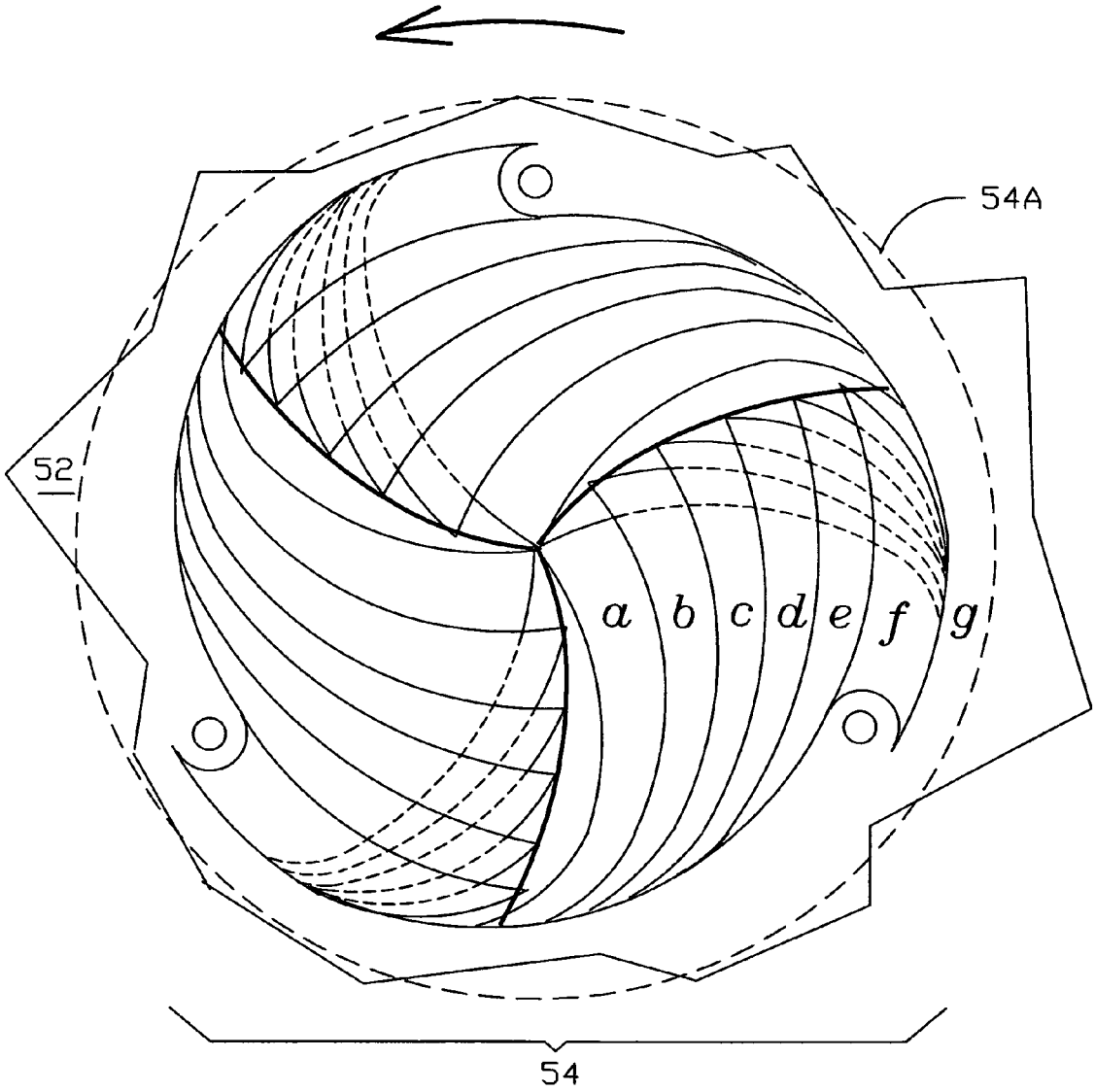
FIG. 7 is an enlarged bottom view at the lower open end of the hub of FIGS. 5 and 6, showing the seven cross-sectional outlines at levels a-g indicated in FIG. 6 and showing the actual leading edges of the three vanes in heavier black lines.

FIG. 7 is an enlarged bottom view at the lower open end of the hub 54 of FIGS. 5 and 6, showing the seven cross-sectional outlines of the three support vanes at levels a-g indicated in FIG. 6, and showing the actual leading edges of the three support vanes in the heavier black lines and the outline of end ring 54A in the dashed circle.

Figure 8:
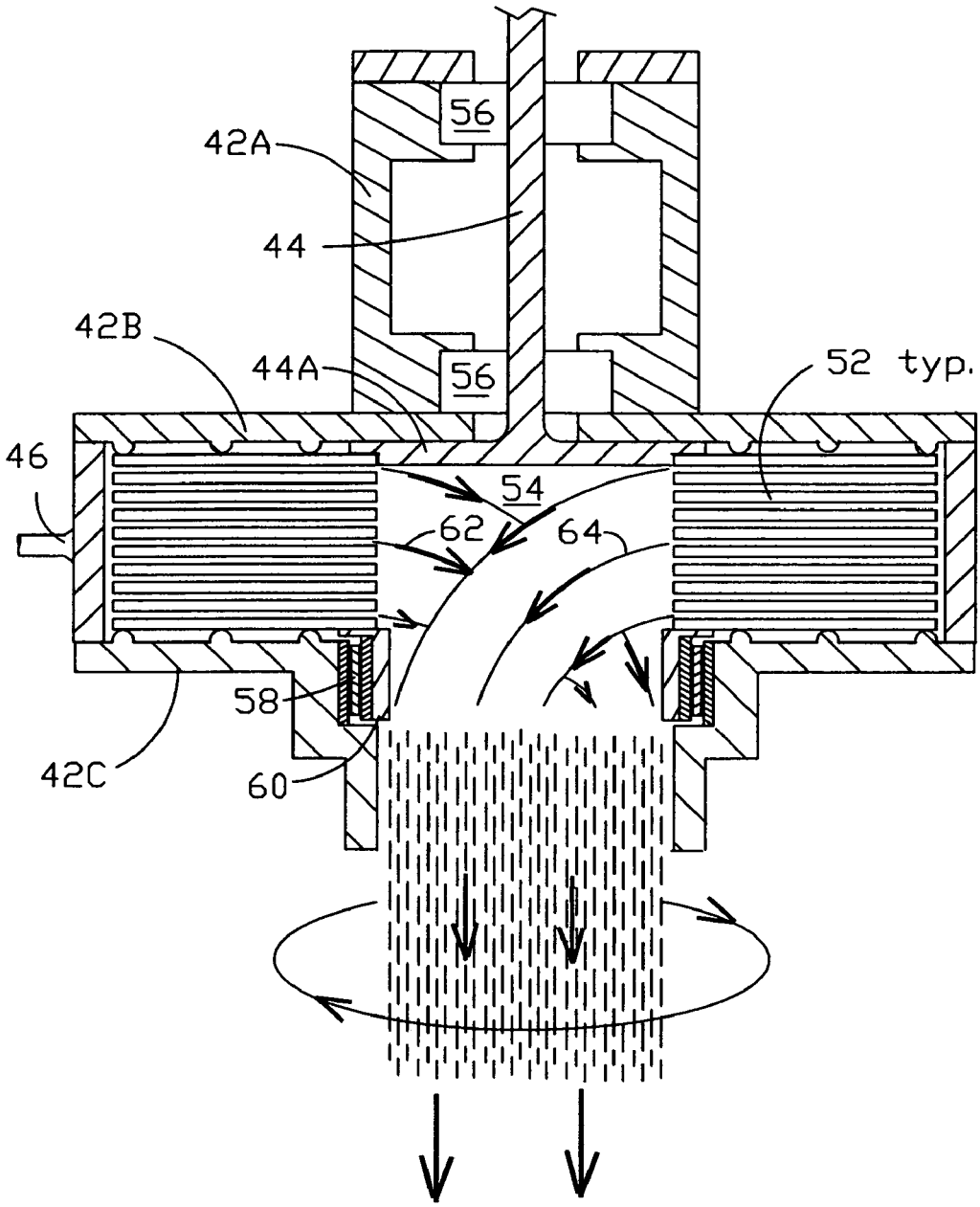
FIG. 8 is a cross-sectional representation of the disc turbine of the present invention as in FIG. 2, showing generalized gas flow within the rotor hub region, entering from the stack of discs and exiting to the axial tubular exhaust passageway.

FIG. 8 is a cross-sectional representation of a disc turbine in accordance with the present invention as in FIG. 2, taken through the central axis of shaft 44. The rotor portion is supported by two bearing sets 56 supporting shaft 44 in the bearing enclosure portion 42A and a bearing set 58 beneath the hub 54 running on an annular bearing collar 60 attached to the lower end of hub 54. The stepped enclosure portion 42C supports bearing set 58 and extends downwardly to form the tubular exhaust passageway. Enclosure portion 42B, attached to bearing enclosure portion 42A, completes the overall enclosure that is made to fit closely around the stack of discs 52 in the rotor. Seals are deployed in critical places to prevent steam from attacking the bearings.

The gas flow paths 62 and 64, shown in hub 54 in lieu of structural detail for clarity, are of the same generalized nature as those shown and described in connection with FIG. 1: they are intended only to indicate the general direction of gas flow in the XY axis as presented in FIG. 1. However these XY flow paths must always be further visualized in three dimensions as taking place as a multi-turn spiral path, with the gas spiraling inwardly at high velocity toward the central axis in a laminar flow in a plane in the XZ axis in the spaces between the discs 52. Throughout this spiral path there is a general expansion of the gas, resulting in progressively reduced pressure, reduced temperature and increased velocity as the gas drives the rotation of the rotor by the boundary layer "drag" action on the upper and lower surfaces of discs 52.

Flow path 62 should be considered distal while flow path 64 is proximal, both showing generally relatively large radius of curvature that accomplishes a smooth transition in making the essentially 90 degree turn from generally horizontal between discs 52 to generally vertical (downward) in the exhaust passageway of enclosure portion 46C.

In contradistinction from FIG. 1, the exhaust passageway is tubular, i.e. circular in cross-section, consequently that there is no opposition to the desired vortex exhaust flow pattern that is carried over from the spiral flow pattern in the stack of discs 52, due to the specially shaped vanes in hub 54 as described in connection with FIGS. 6 and 7.

The embodiment described above also functions, to an extent, as a second-stage energy-recovery blade-type turbine. This beneficial attribute results as an artifact of the shape of the vanes in hub 54, coupled with the resultant flow paths and structure of the exhaust passageway which evolved in attaining the primary objects of the structure. Hence, the system, in essence, contributes a relatively small amount of torque to the driveshaft 44, in addition to the main torque received from the disc stack.

As an alternative to providing three sets of bearings as shown, as a matter of design choice, with appropriate mechanical engineering design and attention to gas sealing, the invention could be practiced with any two of the three bearing sets shown. Elimination of the bearing sets 58 would enable the annular bearing collar 60 to be replaced by a simple annular end plate for the disc stack.

The direction of rotation shown is arbitrary: the discs 52 could be made to operate in either direction by simple inversion; however the configuration of the vanes in hub 54 is strictly unidirectional: the hub 54 must be designed and manufactured for a predetermined direction of rotation.

Instead of three vanes in hub 54, it may be possible to practice the invention with four or more vanes, or even with two vanes, subject to appropriate redesign and optimization of the particular shape of the vanes.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions, and changes that come within the meaning and range of equivalency of the claims are therefore intended to be embraced therein.

What is claimed is:

1. A disc type turbine comprising:

a stack of identical circular discs, each configured with a generally circular central opening that is concentric about a common central axis, adjacent discs being spaced apart by a predetermined separation dimension;

a generally cylindrical hub, closely fitted in the central opening of the discs and driven rotationally from said stack of discs, said hub being configured to form a plurality of identical vanes located in a symmetric polar array about the central axis, each vane being generally tapered to have a cross-sectional shape that, starting from a large vane area in an upper-end region of the hub where the vanes occupy a predominance of cross-sectional hub area, evolves smoothly and progressively to a small vane area in a lower-end region of the hub where a predominance of cross-sectional hub area thus remains as open space available for gas flow;

disc-to-hub driving means, made and arranged to drive said hub rotationally in a predetermined direction from said stack of discs without direct attachment between said hub and said stack of discs;

a generally annular enclosure having a main portion closely surrounding said stack of discs, having a bearing support portion extending upwardly from the main portion and having a tubular exhaust passageway portion extending downwardly from the main portion, in fluid communication with said hub;

a nozzle, receiving pressurized fluid as input, mounted in said enclosure in a manner to direct the input fluid in a predetermined generally radial direction onto a peripheral region of said stack and into the inter-disc separations;

a driveshaft attached to said hub and extending upwardly therefrom and through a concentric shaft opening in the bearing support portion of said enclosure; and a bearing system of at least two sets of bearings supporting at least said shaft rotationally from said enclosure.

2. The disc type turbine as defined in claim 1, wherein the plurality of identical vanes in said hub comprise three identical vanes, each extending generally from an outer cylindrical surface region of said hub to a solid enclosed region at the upper end of said hub.

3. The disc type turbine as defined in claim 2 further comprising a disc-to-hub drive system made and arranged to drive said hub, and thus said driveshaft, rotationally from said stack of discs with no direct fastening between said hub and said stack of discs, for purposes of accommodating thermal expansion effects.

4. The disc type turbine as defined in claim 3 further wherein in said disc-to-hub drive system comprises:

the generally circular central opening in each disc being configured as a series of three spirals each encompassing 120 degrees rotation about a common portion of the central axis such that adjacent spiral ends are offset radially by a designated radial distance defining key length;

the central opening being completed by three key steps extending across the designated radial distances at the ends of the three spirals; and said hub being configured around the cylindrical surface thereof in a pattern that complements and mates with the central opening in the disc stack, including three key steps configured in said hub that match and bear against the three corresponding key steps in the disc stack, the spirals being oriented such as to cause the disc stack to drive said hub rotationally via torque transmitted at the key steps when said stack of discs is driven to rotate in a predetermined direction by fluid from said nozzle.

5. The disc type turbine as defined in claim 4 further wherein each key step in said disc-to-hub drive system is configured as a semicircle with ends thereof coinciding with the ends of the three spirals and curved portion thereof extending in direction of rotation of the discs.

6. The disc type turbine as defined in claim 5 further comprising each disc being configured with three circular openings, each located approximately at a center point of a corresponding one of the three semicircles at key steps in said disc-to-hub drive system, for purposes of enabling the discs to be held in alignment, typically by a threaded rod traversing the circular openings, with further capability of establishing disk-to-disk spacing by spacers interleaved between adjacent disks.

7. The disc type turbine as defined in claim 1, wherein said bearing system comprises:

a first set of bearings surrounding a region of said driveshaft located above and in proximity to said hub; and a second set of bearings surrounding a region of said driveshaft located in proximity to an upper end of said enclosure.

8. The disc type turbine as defined in claim 1, wherein said bearing system comprises:

a first set of bearings surrounding a region of said driveshaft located above and in proximity to said hub;

an annular bearing collar attached to the lower end of said hub and extending downwardly therefrom, and a second set of bearings, surrounding said annular bearing collar and supported from a region of said enclosure near the lower end of said hub.

9. The disc type turbine as defined in claim 1, wherein said bearing system comprises:

a first set of bearings surrounding a region of said driveshaft located above and in proximity to said hub;

a second set of bearings surrounding a region of said driveshaft located in proximity to an upper end of said enclosure;

an annular bearing collar attached to the lower end of said hub and extending downwardly therefrom; and a third set of bearings, surrounding said annular bearing collar and supported from a region of said enclosure near the lower end of said hub.

* * * * *